United States Patent [19]

van der Werff et al.

[11] Patent Number: 4,985,013

[45] Date of Patent: Jan. 15, 1991

[54] METHOD AND AN APPARATUS FOR FOLDING PAPERLIKE MATERIAL, SUCH AS DOCUMENTS, WHICH MAY DIFFER IN QUALITY AND LENGTH AND WHICH ARE CONVEYED IN ASSEMBLED FORM OR SUCCESSIVELY

[75] Inventors: Jeichienus A. van der Werff, Montfoort; Robert van Wijk, Harkema, both of Netherlands

[73] Assignee: Hadewe B.V., Drachten, Netherlands

[21] Appl. No.: 257,816

[22] Filed: Oct. 14, 1988

[30] Foreign Application Priority Data

Oct. 14, 1987 [NL] Netherlands ..... 8702456

[51] Int. Cl.[5] ..... B65H 45/18

[52] U.S. Cl. ..... 493/444; 493/435; 493/442; 493/437; 493/445

[58] Field of Search ..... 493/23, 444, 445, 437, 493/442, 419, 420, 435, 442, 422, 436, 460, 461

[56] References Cited

U.S. PATENT DOCUMENTS

| | | | |
|---|---|---|---|
| 1,243,032 | 10/1917 | Barr | 493/442 |
| 1,734,742 | 11/1929 | Novick | 493/422 |
| 2,145,592 | 1/1939 | Folger | 493/23 |
| 2,997,295 | 8/1961 | Beck | 493/420 |
| 3,117,777 | 1/1964 | Funk | 493/444 |

FOREIGN PATENT DOCUMENTS

| | | | |
|---|---|---|---|
| 0059357 | 2/1982 | European Pat. Off. . | |
| 2945773 | 5/1981 | Fed. Rep. of Germany | 493/419 |
| 1221311 | 2/1971 | United Kingdom | 493/419 |

*Primary Examiner*—Frederick R. Schmidt
*Assistant Examiner*—Jack Lavinder
*Attorney, Agent, or Firm*—Burns, Doane, Swecker & Mathis

[57] ABSTRACT

A method and an apparatus for folding paperlike material, such as documents, which may have different quality and length and are conveyed in assembled form or successively in a transport track, said paperlike material having a leading and a trailing edge and being provided with a fold at a location between its leading and its trailing edge by bending the leading edge and the contiguous portion of the material out of the transport track during conveying of the material until the trailing edge reaches a predetermined position and creating a sharp folding edge by bringing the edge to be folded between folding means by a folding blade moving substantially in the transport track.

10 Claims, 2 Drawing Sheets

Figure 1:
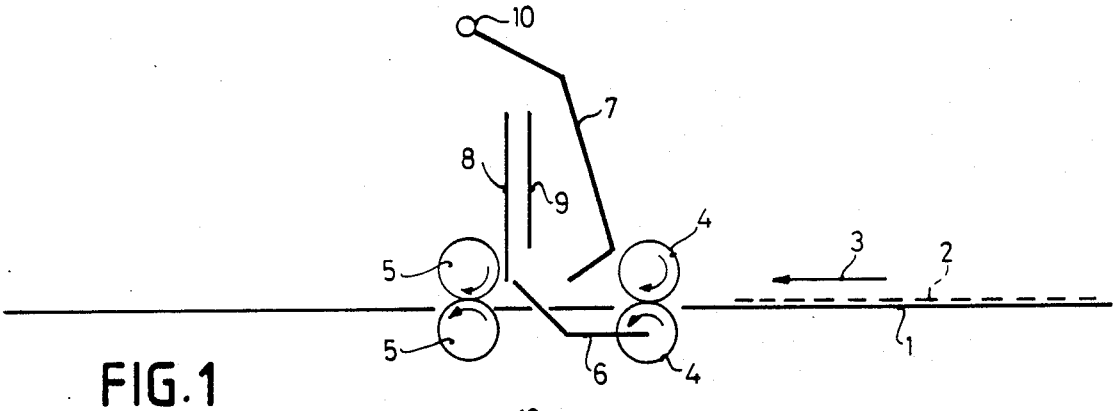

METHOD AND AN APPARATUS FOR FOLDING PAPERLIKE MATERIAL, SUCH AS DOCUMENTS, WHICH MAY DIFFER IN QUALITY AND LENGTH AND WHICH ARE CONVEYED IN ASSEMBLED FORM OR SUCCESSIVELY

This invention relates to a method of folding paperlike material, such as documents, which may differ in quality and length, and which are conveyed in assembled form or successively in a transport track, and wherein the paperlike material is provided with a fold at some distance upstream of its trailing edge, by bending the leading edge and a contiguous portion of the material out of the plane of transport and creating a folded area in which subsequently the desired sharp folded edge is made by folding means, as well as to an apparatus for performing such a folding method.

For the purpose of folding to size and collecting paperlike material, such as documents, to be placed in an envelope, three methods can be used. In the first, the collection and filling are effected on a filling machine, while the folding is done on separate folding machines. It is further possible to fold and fill on a filling machine with integral folding units, one for each document to be folded. Finally, the documents can be collected first and then be folded jointly in superposed relationship, after which the resulting assembly is inserted in an envelope. It will be clear that the last method requires the lowest investment. Moreover, the setting operations in that method are simplest. In the first method, the personnel cost are highest, since this is a multi-phase method.

The third method is therefore decidedly preferred; however, this too, entails a number of problems. Known folding systems using folding tables cannot handle half of the possible paper size combinations, because documents smaller than the largest size in an assembly in most cases are not sufficiently guided. This problem is aggravated when documents have to be added selectively to an assembly, for in that case the largest document size of one assembly may deviate from that of another following or preceding assembly.

Furthermore, the known systems generally give problems during the handling of relatively rigid products, such as credit cards, which e.g. have to be attached to a larger document. This last problem can be solved when at least a part of each document continues to follow a substantially straight path during the folding process, which is not the case in the above known folding method.

This is the case in a method and apparatus as disclosed in EP-A-59357. In these, use is made of folding tables in the form of rotary cylinders having a slot extending radially through the cylinder. In the starting position, the slot is flush with the transport track. The leading edges of incoming documents enter the slot. When the desired part of the document is within the slot, the cylinder is rotated. The part of the document outside the slot is taken along and beds down on the outer face of the cylinder, which is enabled by the feed rollers moving apart. After half a revolution of the cylinder, the document lies with the folded area first in the transport track, which provides for its discharge through a pair of folding rollers, while applying a sharp folded edge. With this method and apparatus, all possible document size combinations can be handled. Entirely non-pliable materials can also be handled, provided these can always be inserted entirely into the slot of the cylinder during a folding operation.

However, this known method entails high cost. On the one hand, due to the required relatively extensive and complex equipment and on the other hand due to the complicated control. Besides, troubles may arise during paper handling by widely varying causes. In such a case, the rotary, slotted cylinder causes poor accessibility of the apparatus and hence cumbersome removal of the cause of the trouble.

EP-A-113358 further discloses a folding apparatus wherein two guide plates are arranged behind the feed rollers on either side of the transport track and substantially parallel thereto, along the front end of which guide plates a steering roller attached to swivelling arms is movable. The folding rollers—as viewed in transport direction—are arranged beyond the swivelling range of the steering roller. A document is passed between the guide plates until the place where the folding edge is to be made is located adjacent the front end of the guide plates. By swivelling movement of the steering roller from one side of the transport track to the other, the document is bent around the front end of either of the guide plates. Swivelling back of the steering roller causes the document to be folded into a V-shape, whereafter the document is guided between the folding rollers with the folded area first.

In this known method, the parts of the documents to be folded over have to be guided past the ends of the guide plates, which practically always means transporting them past the folding rollers. The swivelling steering roller causes the part of the documents ahead of the guide plates to be turned back, so a part of the documents should be retracted through the folding rollers. This not only means switching off the drive of the folding rollers, but also moving them apart and chafing the document along at least one of the rollers. Besides, the steering roller, during swivelling back, engages with the document at some distance behind the folding edge to be formed, so that the folded area is fed to the folding rollers in a not accurately defined form which may result in a not entirely correctly positioned and/or straight folded edge.

It is an object of the present invention to improve a folding method of the above described type in such a manner as to eliminate the above drawbacks.

This is achieved according to the present invention, by bending the leading edge and the contiguous portion of the paperlike material out of the plane of transport during the feeding of the material and, after the desired portion of the material has been bent out of the plane of transport, the edge to be folded is brought between the folding means by a folding blade moving substantially in the transport direction. These features allow the folded area to be brought in a leading position in a comparatively simple and direct manner, whereafter the folding blade is activated, which feeds that portion of the material where a sharp folded edge has to be formed in direct engaging relationship with the nip between the folding rollers. Thus, the provision of a folded edge at the desired place and in the desired shape can always be realized in an optimum and comparatively simple manner. The bent off portion of the material requires no complicated pick-up members but, in fact, only a free movement space, so that in case of trouble, the material is easily accessible and the operations necessary for removing the trouble can be carried out without any problem.

In case the paperlike material has already been subjected to a first folding operation, it is recommendable during the second or following bending out of the plane of transport that steps are taken that counteract any de-folding. According to a further embodiment of the present invention, this can be realized when the portion of material bent out of the plane of transport is pressed in the direction of a stationary guiding face before the folded edge is fed to the folding means. Thus, not only de-folding is prevented but likewise it is ensured that during the feeding of the folded area to the folding rollers, the leading edge of the earlier folded portion of the paperlike material abuts substantially in face-to-face relationship against the portion of the material contiguous with the folded area, so that also the earlier folded portion, together with the folded area, arrives in the correct, desired manner in the nip between the folding rollers.

It will be clear from above that the rearmost portion of the pliable material always remains in the transport track. This rearmost portion should therefore contain any non-pliable material present. Thus, it is preferred to take the rearmost portion, remaining in the transport track during the entire folding operation, as reference portion when determining the place or places where a fold has to be formed. In this connection, it is preferred according to a further embodiment of the present invention that during the feeding of assembled pliable material, this is fed with its trailing edges in jogged relationship, so that the place of any non-pliable parts present is always accurately defined, and moreover, it is further preferred that during the feeding of the material, the trailing edge thereof is detected, and the information obtained is used for applying the fold to be formed at the desired place, or that the position of the trailing edge of the material is detected and followed, and the resulting information is used for applying the fold to be formed at the desired location. A quick steering, adjustable per each case, can then be achieved when the information on the desired place of the fold to be formed is communicated electronically from another control system to the control of the folding unit, while furthermore the information on the desired place of the fold forms part e.g. of a pre-programmed job setting.

For the accurate location of the fold to be formed, it is recommendable according to a further embodiment of the present invention that the folding blade, at least when approaching the folding means, is displaced at a speed equal to the conveying speed. To realize this optimally with features as simple as possible, it is further preferred that when a desired position is reached by the folding edge to be made, the conveyance is stopped, drive means for the folding blade are coupled to drive means for the conveyance, and subsequently the drive means for the folding blade and the conveyance are started jointly, or that the displacement of the folding blade is related electronically by means of a start-up procedure to the instantaneous position of the trailing edge of the pliable material. The accurate stopping at the correct place can be promoted when the stopping cycle of the conveyance is started after the conveying speed has been reduced.

The present invention also relates to an apparatus for folding paperlike material, such as documents, that may differ in quality and length and are fed in assembled form or successively, which apparatus, as e.g. disclosed in EP-A-59357, is provided with a transport track with conveying or feeding means and—as viewed in transport direction—folding rollers arranged downstream thereof, as well as guide means disposed between the conveying means and the folding rollers. This allows a method as described above to be performed advantageously when in accordance with the present invention, it is ensured that the guide means comprise a folding blade provided with a free end that is displaceable into the nip between two folding rollers and in that displacement area is approximately tangent to the transport track, as well as bending-off means for at least the trailing edge of the paperlike material. These features allow the paperlike material to be bent out of the transport track in a simple but effective manner by swivelling the bending-off means into the transport track. After the desired portion of the material has been bent out of the transport track, the guide member is swivelled away and the folding blade is moved in the direction of the folding area of the material. The free end of the folding blade comes into contact with the material and presses it positively into the nip between the folding rollers, so that the folding edge to be formed is always forcibly provided with the straight, desired configuration. Both the bending-off means and the folding blade may, in principle, be platelike, bent or non-bent elements, with which the relative simplicity and the easy accessibility of the folding apparatus are illustrated.

Bending the paperlike material out of the transport track is possible in an effective and comparatively simple manner when the bending-off means comprise a guide member having a bending-off face, which is arranged between the transport means and the folding rollers, said bending-off face swivelling between a position intersecting the transport track and a position not intersecting the track.

When in accordance with a further embodiment of the present invention, it is ensured that between the transport means and the folding rollers, beyond the transport track, there is arranged a guide plate substantially contiguous with the bending-off face when the guide member is in its position intersecting the transport track, it is effected in a further advantageous manner that the bent-off portions of the paperlike material are further guided by the guide plate contiguous therewith in that position of the guide member.

In order to impart to the bent-off portion of the paperlike material an additional guidance and support, especially when the bending-off is effected in upward direction, it is preferred according to a further embodiment of the present invention that upstream of the guide plate a second guide plate is arranged at a relatively small distance therefrom and substantially parallel thereto. In particular when a second or following folding step has to be made in the folding apparatus, it is preferred according to a still further embodiment of the present invention that the second guide plate is arranged for swivelling motion relative to the first, while the distance between the two plates on that side where the guide member is present can be increased and reduced. This feature ensures both the conveyance of the earlier folded and subsequently bent-off portion of the documents, as well as the subsequent proper conveyance to the folding rollers, in that on the one hand always sufficient room can be created between the two guide plates for reliably inserting the bent-off documents, while on the other hand that room can be restricted in such a manner that the then three or more layers of documents are guided in entirely or substantially entirely flat condition into the nip between the folding rollers.

The simplicity of the construction can be promoted when according to a still further embodiment of the present invention the folding blade and the second guide plate are mounted on the same swivel shaft, which is enabled by their uniform displacements. However, it is preferred that the folding blade and the second guide plate can be swivelled independently from one another. As a result, after reaching an optimum delivery position between the two guide plates, independently thereof, the folding blade can be brought into its optimum conveying position relative to the folding rollers and, after the paperlike material has been introduced into the nip, can be swivelled back into a position not impeding the moving material but guiding it as much as possible. In order to further promote the latter situation, it is preferred that according to a further embodiment of the present invention, the second guide plate, on that side where the guide member is disposed, is provided with an end bent over towards the folding rollers, so that the bent-off portions of the material originating from the space between the two guide plates can be guided optimally into a flat position on the non-deflected portion of the material.

Some embodiments of the folding method and apparatus according to the present invention will now be described, by way of example, with reference to the accompanying diagrammatical drawings, in which:

FIGS. 1–4 are side views of an embodiment of a folding apparatus according to the present invention in a number of successive operating positions; and FIGS. 5–9 are again side views of a variant of the embodiment shown in FIGS. 1–4 and in a number of successive operating positions.

The folding apparatus shown in FIGS. 1–4 comprises a transport track 1 for platelike material, such as documents 2, which can be conveyed separately or in assembled form. The displacement of documents 2 is effected in the direction indicated by arrow 3 along the transport track 1 and can take place in any suitable manner, e.g. by means of rollers and/or belts. FIGS. 1–4 show a pair of feed rollers 4 pertaining to the transport means, said rollers being arranged on either side of transport track 1. As viewed in the direction of transport, downstream of the feed rollers 4, there is arranged a pair of folding rollers 5, one on each side of the transport track 1. Arranged between feed rollers 4 and folding rollers 5 is a plurality of guide means, consisting of a guide member 6, a folding blade 7, a first guide plate 8 and a second guide plate 9.

The guide member 6 is formed by a bent plate which on its one end is pivoted about a shaft parallel to that of the feeding and folding rollers 4, 5. Said shaft, as shown in the drawing, can coincide with either of the feed roller shafts, with the proviso that guide member 6 should be movable independently of feed roller 4. The free end of guide member 6 is provided on a plate portion placed and oriented relatively to its swivel shaft in such a manner that said portion, depending upon the swivelling position of the guide member 6, can or cannot intersect transport track 1.

The folding blade 7, as guide member 6, is formed substantially by a bent plate suspended pivotally on one end. The free end of folding blade 7 is present on a bent plate portion positioned and oriented relative to pivot pin 10 in such a manner that said plate portion, upon swivelling motion about pivot pin 10, can approach transport track 1 substantially in tangent relationship, with the free end being adapted to extend into the nip between folding rollers 5, thereby acting as a folding blade.

Guide plate 8 extends on the same side of transport track 1 as folding blade 7 substantially vertically. The lower end of guide plate 8 lies at a level at which it only just overlaps the free end of guide member 6 when this is in its upper position, i.e. intersecting transport track 1, viz. on the side of folding rollers 5. Guide plate 9 extends upstream at a relatively short distance from guide plate 8 and parallel thereto. Guide plate 9 terminates at a higher level than guide plate 8.

Figure 2:
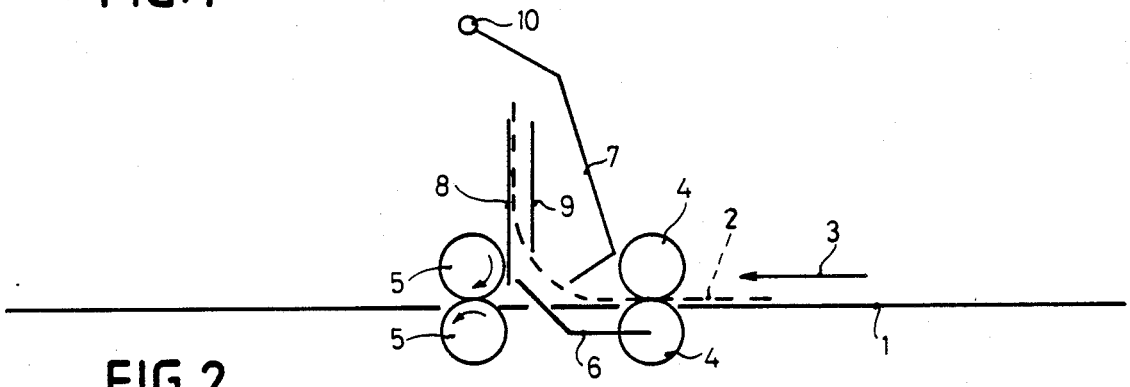
Figure 3:
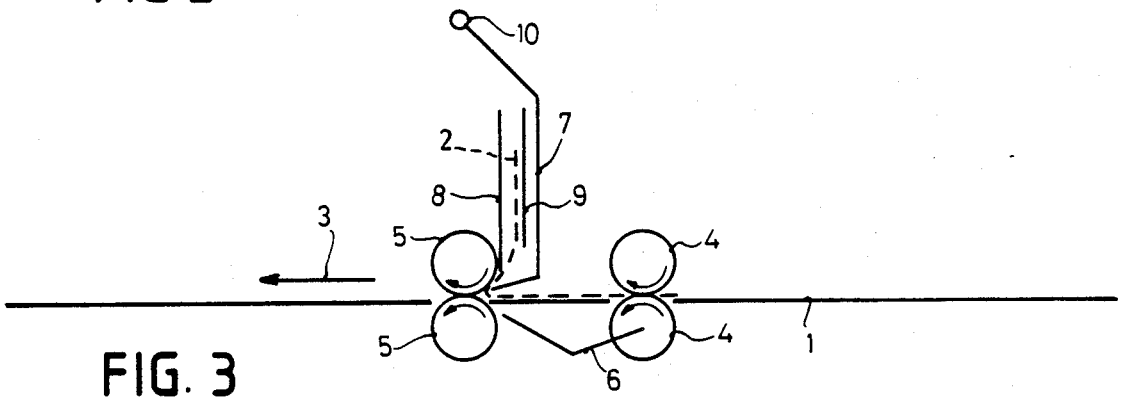
Figure 4:
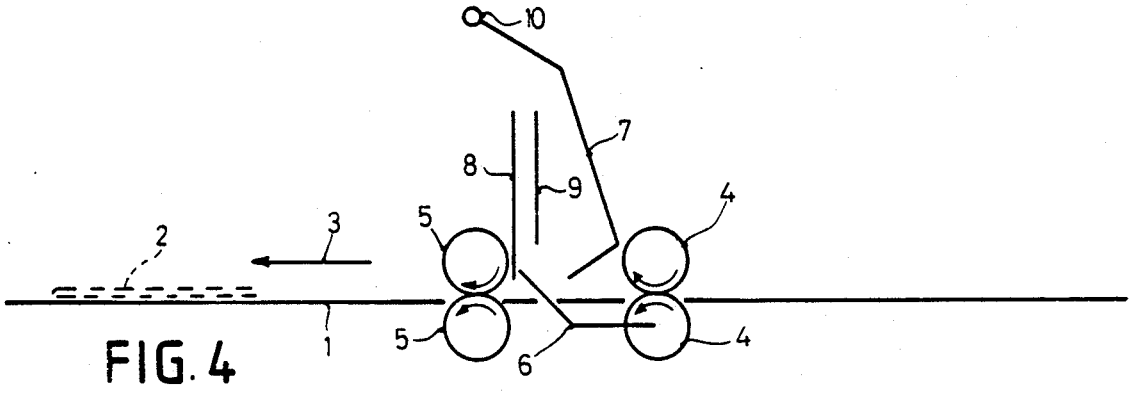

As shown in FIG. 1, a document 2 or assembled documents conveyed via transport track 1, will arrive with its or their leading edge(s) in the nip between the feed rollers 4, thereby being further transported positively. Guide member 6 is then in its upward swivelling position, so that the documents 2, as shown in FIG. 2, are bent out of transport track 1 in upward direction and arrive between guide plates 8, 9. This displacement of documents 2 is continued until a given length of document has remained on transport track 1. This length can be determined e.g. by detecting the trailing edge of the documents. With a view to an optimum operation, documents assembled to a stack should then be fed preferably with their trailing edges in flush relationship. After guide member 6 has swivelled into its lowest position, folding blade 7 is swivelled forwards, thereby bringing with its leading free edge the documents 2 folded into a V-shape into the nip between folding rollers 5, so that the position shown in FIG. 3 has been reached. Folding rollers 5 make a sharp folded edge in documents 2 and likewise ensure the discharge of the thus folded documents 2. After folding blade 7 has swivelled back and guide member 6 has swivelled upwards, the apparatus is again in its starting position, as shown in FIG. 4, likewise showing the folded documents 2 being discharged.

FIGS. 5–9 show a variant of the above described folding apparatus wherein identical parts are indicated by identical reference numerals. The difference resides in a different design of the second guide plate, which is now indicated by numeral *9a*. Guide plate *9a*, as the folding blade, is formed from a bent plate pivotally suspended on its one end and provided on its other end with a plate portion bent over in the direction of transport. Guide plate *9a* may be pivotal about the same shaft as folding blade 7 but is preferably swivelling, and in the present embodiment independently of folding blade 7.

This embodiment can be used advantageously during the second or following folding of the documents fed. FIGS. 5–9 show a document already subJected to a first folding step and indicated by numeral *2a*. Instead of a single document *2a* folded in one pass, also a plurality of stacked documents already folded in one pass can be fed.

Figure 5:
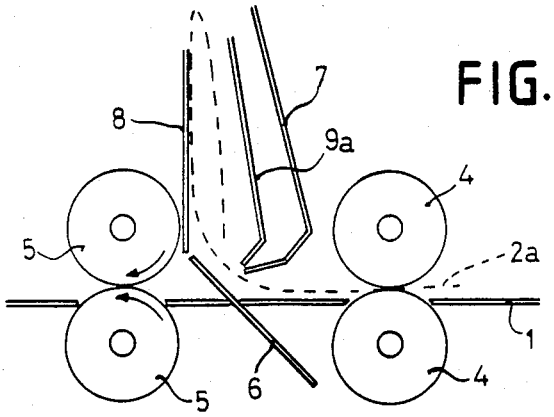
Figure 6:
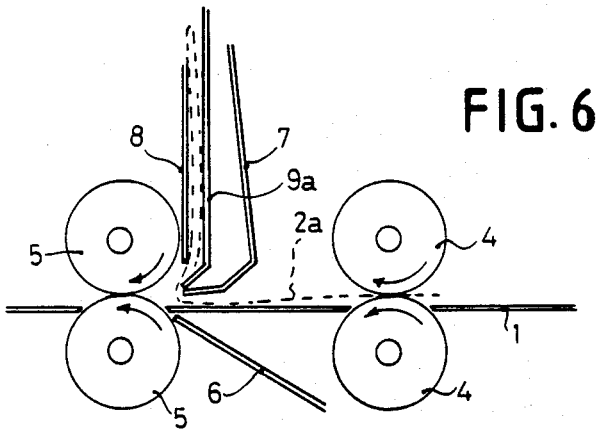
Figure 7:
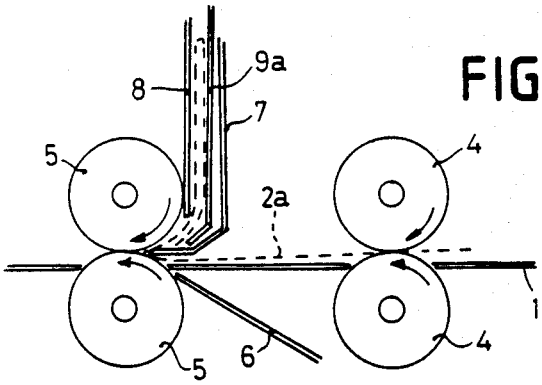
Figure 8:
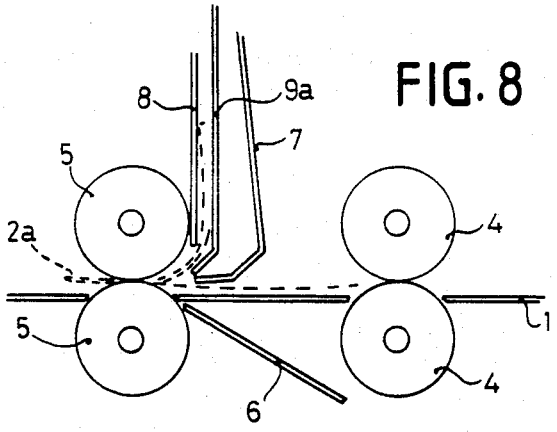

FIG. 5 shows a position corresponding with FIG. 2, i.e. the position wherein the desired length has been bent upwards out of transport track 1 and guide member 6 is about to be swivelled downwards. Preferably, the portion of document *2a* folded back during an earlier folding step, in that position, is entirely slid between guide plates 8 and *9a*, as shown in FIG. 5. After guide member 6 has swivelled downwards, guide plate *9a* and folding blade 7 are swivelled forwards into the position shown in FIG. 6. The forward swivelling of guide plate *9a* has the advantage that any partial de-folding of document *2a*, as also indicated in FIG. 5, is removed again and the document folded back earlier will again abut in face-to-face relationship against the opposite document portion. When this position is reached, the swivelling motion of guide plate 9a is stopped, but the swivelling motion of folding blade 7 is continued until the position shown in FIG. 7 is reached, in which folding blade 7 presses V-shaped document 2a into the nip between folding rollers 5. After folding rollers 5 have engaged document 2a in such a manner that this is pulled further into and through the nip, folding blade 7 is swivelled back slightly in order to provide room for the portion of document 2a withdrawn from the space between guide plates 8 and 9a. The proper guidance of the portion of the document is then ensured by the bent over portion at the lower end of guide plate 9a. After the document, folded a second time by folding rollers 5 has thus been discharged, guide plate 9a and folding blade 7 are swivelled back and guide member 6 is swivelled upwards, thus again reaching the starting position, as shown in FIG. 9 likewise showing the document 2a folded twice.

Figure 9:
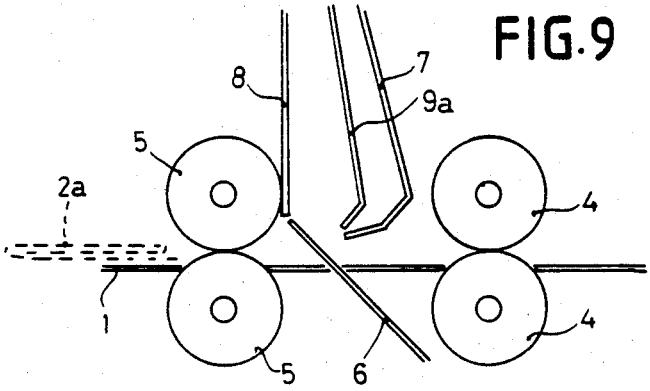

As shown in FIG. 9, there is obtained a wrapping fold. When a zigzag fold is desired, it is necessary during the first folding step for the document to be bent off downwards out of the transport track, or an approximately twice as long first folding length should be set.

It is self-evident that many modifications and variants are possible within the scope of the present invention and that the embodiments are given exclusively as non-limiting examples of the present invention. In the discussion of these examples, a number of variants have already been indicated. Besides, for instance guide means 6–9 may have any other suitable and desired shape, such as a smooth instead of a bent configuration. Nor need the guide means be plates, but these may be composed of striplike or rodlike and/or extruded parts. The guide plates are shown in a practically always vertical position; even when a different angular position is occupied can the folding method be carried out, while in the example shown in FIGS. 1–4, in which a first fold is made, guide plate 9 may be omitted.

We claim:

1. An apparatus for folding paperlike material, such as documents, comprising:

a transport track having transport means for transporting the paperlike material, and folding rollers arranged downstream of said transport means as viewed in the transport direction;

a swiveling folding blade having a free end that swivels into a nip between two folding rollers, said free end swiveling substantially tangentially to said transport track; and guide means arranged between said transport means and said folding rollers, said guide means including deflection means for deflecting at least a leading edge of said paperlike material and including a guide member having a deflection face arranged between said transport means and said folding rollers, said deflection face arranged for swiveling between a first position intersecting said transport track and a second position that does not intersect said track, a guide plate that is substantially contiguous to said deflection face when said guide member is in said first position, said guide plate being positioned between said transport means and said folding rollers outside said transport track, and a second guide plate arrangement upstream and substantially parallel to said guide plate at a relatively small distance from said guide plate, said second guide plate being arranged in a swiveling relationship to said guide plate, and a distance between said guide plate and said second guide plate being variable.

2. An apparatus as claimed in claim 1, wherein said free end of said folding blade is displaced at a speed equal to a transporting speed of said transport track at least when said folding blade approaches said folding rollers.

3. An apparatus as claimed in claim 2, wherein said transporting track is stopped when an edge of the paperlike material to be folded reaches a desired position, and a drive means for said folding blade is then coupled to a drive means for said transport track, and subsequently, said drive means for the folding blade and said drive means for said transport track are started jointly.

4. An apparatus as claimed in claim 3, wherein said transport track is stopped after a speed of said transport track has been reduced.

5. An apparatus as claimed in claim 2, wherein swiveling of said folding blade is related electronically by a start-up procedure to the position of a trailing edge of the paperlike material.

6. An apparatus as claimed in claim 1, wherein said folding blade and said second guide plate are mounted on a same swivel shaft.

7. An apparatus as claimed in claim 6, wherein said folding blade and said second guide plate are arranged to swivel independently from one another.

8. An apparatus as claimed in claim 1, wherein said second guide plate includes an end bent towards said folding rollers at said side where said guide member is located.

9. An apparatus for folding paperlike material, such as documents, comprising:

a transport track having transport means and folding rollers arranged in a downstream direction as viewed in the transport direction;

a swiveling folding blade having a free end that swivels into a nip between two folding rollers, said free end swiveling substantially tangentially to said transport track; and guide means arranged between said transport means and said folding rollers, said guide mans comprising deflection means for deflecting at least the leading edge of the paperlike material, said deflection means including a guide member having a deflection face arranged between said transport means and said folding rollers, said deflection face arranged for swiveling between a first position intersecting said transport track and a second position that does not intersect said track, wherein a guide plate that is substantially contiguous to said deflection face when said guide member is in said first position is positioned between said transport means and said folding rollers outside said transport track, and wherein a second guide plate is arranged upstream and substantially parallel to said guide plate at a relatively small distance from said guide plate, and wherein said guide plate is arranged in a swiveling relationship to said guide plate such that said distance between said guide plate and said second guide plate is variable, and wherein said folding blade and second guide plate are mounted on a same swivel shaft.

10. An apparatus as claimed in claim 9, wherein said folding blade and said second guide plate are arranged to swivel independently from one another.

* * * * *